US011644032B2

(12) United States Patent
Laufer et al.

(10) Patent No.: US 11,644,032 B2
(45) Date of Patent: May 9, 2023

(54) PUMP WITH DETECTION OF ABSOLUTE ANGLE OF ROTATION

(71) Applicant: ebm-papst St. Georgen GmbH & Co. KG, St. Georgen (DE)

(72) Inventors: Wolfgang Laufer, Aichhalden (DE); Jens Loeffler, Villingen-Schwenningen (DE); Mario Staiger, Schramberg-Tennenbronn (DE); Daniel Hauer, Ortenberg (DE); Markus Braxmaier, VS-Schwenningen (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 77 days.

(21) Appl. No.: 17/255,365

(22) PCT Filed: Jul. 1, 2019

(86) PCT No.: PCT/EP2019/067542
§ 371 (c)(1),
(2) Date: Dec. 22, 2020

(87) PCT Pub. No.: WO2020/020577
PCT Pub. Date: Jan. 30, 2020

(65) Prior Publication Data

US 2021/0262466 A1 Aug. 26, 2021

(30) Foreign Application Priority Data

Jul. 26, 2018 (DE) ..... 10 2018 118 100.0

(51) Int. Cl.
*F04C 14/06* (2006.01)
*F04C 5/00* (2006.01)
(Continued)

(52) U.S. Cl.
CPC ..... *F04C 14/06* (2013.01); *F04C 5/00* (2013.01); *F04C 14/08* (2013.01); *F04C 14/28* (2013.01);
(Continued)

(58) Field of Classification Search
CPC ..... F04C 2240/81; F04C 5/00; F04C 14/06; F04C 14/08; F04C 14/28; F04C 2220/24;
(Continued)

(56) References Cited

U.S. PATENT DOCUMENTS 664,507 A * 12/1900 Singer ..... F04B 43/1238 92/144
3,408,947 A * 11/1968 McMillan ..... F04B 43/14 418/45
(Continued)

FOREIGN PATENT DOCUMENTS

DE 102014109558 A1 * 7/2014 ..... F04C 14/00
DE 10 2014 109558 A1 1/2016
(Continued)

OTHER PUBLICATIONS

International Search Report dated Sep. 24, 2019, which issued in corresponding PCT Patent Application No. PCT/EP2019/067542, including Eng. translation.

*Primary Examiner* — Kenneth J Hansen
*Assistant Examiner* — Benjamin Doyle
(74) *Attorney, Agent, or Firm* — Dickinson Wright PLLC

(57) ABSTRACT

The invention relates to an orbital pump for pumping a fluid, wherein the pump comprises at least one pump control system, a motor that can be controlled by the pump control system, a rotor shaft (10) for fluid transport, and a rotor sensor for detecting an absolute angle of rotation of the rotor shaft (40), the rotor sensor is connected to the pump control system and designed to transmit the angle of rotation of the
(Continued)

rotor shaft (40) to the pump control system, and the pump control system is designed to rotationally control the rotor shaft (40) by means of the motor until the rotor shaft (40) is in a pre-determined angle of rotation position.

14 Claims, 1 Drawing Sheet

(51) Int. Cl.
*F04C 14/08* (2006.01)
*F04C 14/28* (2006.01)

(52) U.S. Cl.
CPC ..... *F04C 2240/20* (2013.01); *F04C 2240/40* (2013.01); *F04C 2240/81* (2013.01); *F04C 2270/0525* (2013.01); *F04C 2270/20* (2013.01)

(58) Field of Classification Search
CPC ..... F04C 2240/20; F04C 2240/40; F04C 2270/0525; F04C 2270/20
USPC ..... 417/44.1
See application file for complete search history.

(56) References Cited

U.S. PATENT DOCUMENTS 3,644,061 A * 2/1972 McFarlin ..... F04B 43/0072 417/199.2
4,332,534 A * 6/1982 Becker ..... F04B 43/0054 418/153
4,476,837 A * 10/1984 Salzgeber ..... F02D 41/401 123/502
4,998,865 A 3/1991 Nakanishi et al.
5,386,372 A * 1/1995 Kobayashi ..... G10K 11/17855 700/280
5,670,852 A * 9/1997 Chipperfield ..... F04C 11/008 318/250
6,652,249 B2 * 11/2003 Kenney ..... H02K 11/33 310/87
7,167,793 B1 * 1/2007 Gibson ..... F02D 41/009 701/115
7,474,024 B2 * 1/2009 Nakanishi ..... F04D 13/064 310/71
2006/0051217 A1 * 3/2006 Felton ..... F04C 5/00 417/321
2008/0075608 A1 * 3/2008 Suzuki ..... F04C 14/08 417/410.1
2009/0282845 A1 11/2009 Hasegawa et al.
2010/0319560 A1 * 12/2010 Fischer ..... B41F 31/004 101/349.1
2011/0194954 A1 * 8/2011 Sakata ..... F04C 15/008 417/410.1
2014/0017094 A1 * 1/2014 Ghodsi-Kameneh ... F04B 43/14 417/44.1
2015/0377106 A1 * 12/2015 Brück ..... F04B 43/08 60/274
2016/0032914 A1 * 2/2016 Brück ..... F04C 2/30 417/405
2016/0108785 A1 * 4/2016 Brück ..... F01N 3/208 60/301
2017/0114691 A1 * 4/2017 Hodgson ..... F01N 3/2066
2017/0138358 A1 * 5/2017 Maguin ..... F04B 43/123
2017/0292428 A1 * 10/2017 Hodgson ..... F04B 53/16
2018/0010612 A1 * 1/2018 Wegener ..... A61M 1/367
2018/0065141 A1 * 3/2018 Saine ..... B05C 11/1007
2018/0238323 A1 * 8/2018 Brück ..... F04C 5/00
2020/0011309 A1 * 1/2020 Gerz ..... F04B 51/00

FOREIGN PATENT DOCUMENTS

DE 10 2015 203437 B3 6/2016
EP 0 733 803 A2 9/1996
GB 2 385 381 A 8/2003

* cited by examiner

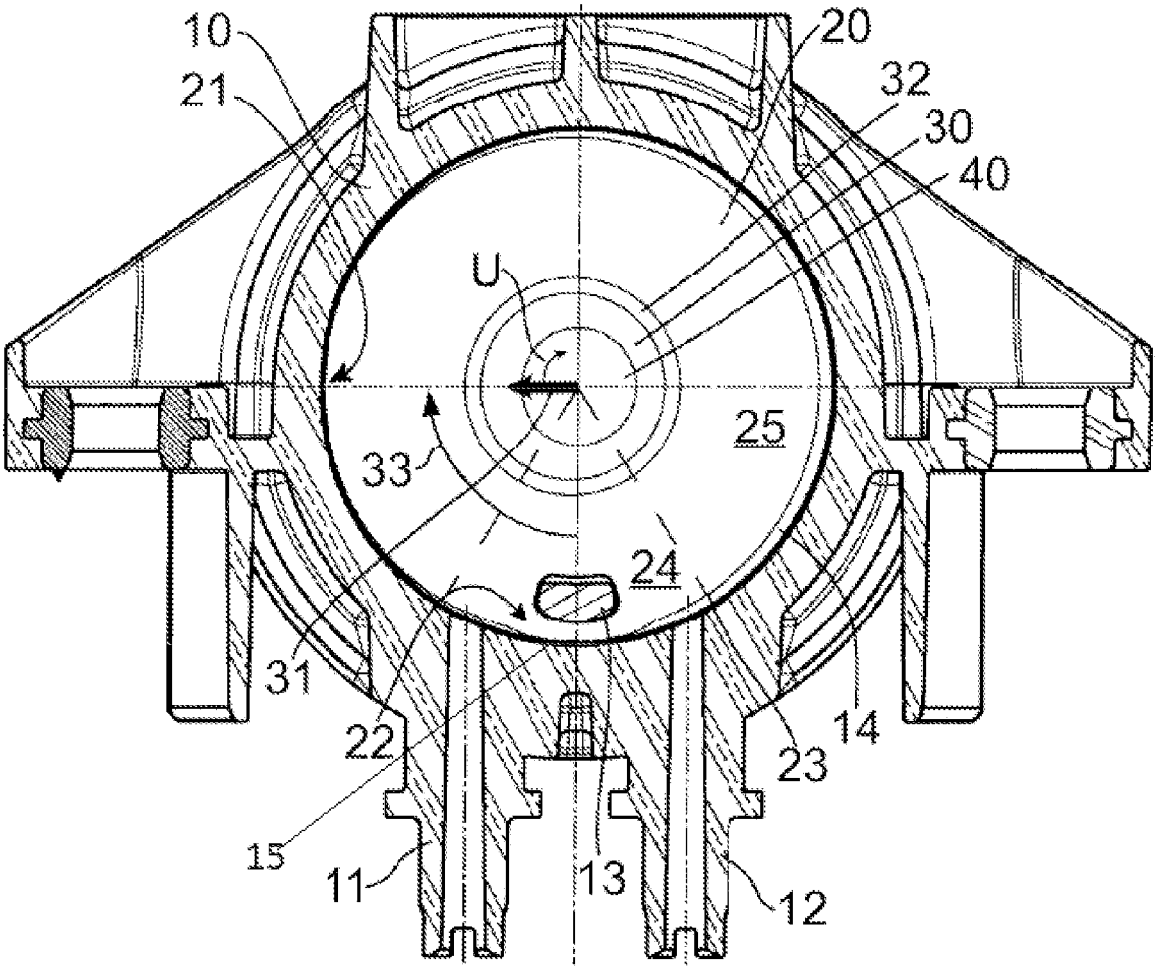
10
21
20
32
30
40
U
25
33
24
31
22
23
14
15
11
13
12

PUMP WITH DETECTION OF ABSOLUTE ANGLE OF ROTATION

The invention relates to a pump, in particular an orbital pump, for pumping a fluid. For this purpose, the pump comprises a rotor sensor for detecting an absolute angle of rotation of the rotor shaft of the pump, as well as a pre-determined angle of rotation position.

Various embodiments of pumps with detection of angles of rotation are already known from the prior art. For example, one known solution detects an angle of rotation position of a rotor by means of three digital Hall sensors that, however, do not enable any absolute rotor location recognition and only allow detection of the angle of rotation of the rotor at a resolution of 20°. The Hall sensors identify the position of the rotor indirectly via the position of the magnetic field exciting the rotor.

During such detection of the angle of rotation, many pumps widely used in the prior art are controlled in an "open-loop" operation, wherein a certain pattern is imprinted on a rotating magnetic field of the motor driving the pump. The rotor will then follow this produced magnetic field more or less precisely. An increased load on the rotor may lead to its lagging behind the magnetic field and the speeds and angles of rotation of the magnetic field and the rotor no longer coinciding. Calculation of the volumetric flow transported and positioning of the rotor will thereby no longer be possible since the actual or absolute angle of rotation of the rotor is unknown.

In addition to the disadvantages of the "open-loop" operation, further limitations and disadvantages also occur with the pumps. For example, in the rotors widely used in the pumps of the prior art, undefined overshooting of the rotor around an approached position occurs. This leads to a diaphragm or other elastic element connected to the rotor being subjected to greater stress than without the overshooting, for example, such that the elastic element experiences increased wear. The overshooting also increases any metering or transport variabilities because the movement of the rotor around the approached position during overshooting causes a fluid to continue to be transported through the pump in an undefined manner.

Additionally, it is impossible to identify the absolute position of the rotor or to position the rotor at a certain position, particularly because the resolution of many rotor sensors widely used in pumps is too low and a position within a range pre-determined by the resolution can be approached at best.

An issue arising especially with previously known orbital pumps is that an eccentric used is stopped at a position not previously determinable, that is, at a non pre-determined angle of rotation, during deactivation of the orbital pump. Due to the undetermined location of the eccentric, the pump is not precluded from comprising an internal leakage, which may cause a leakage flow, whereby fluid flows through the pump in an undefined manner. Therefore, via a speed of the rotor, it is impossible to identify how much fluid has been transported by the pump, or how much fluid is used by a consumer connected to the pump to which the fluid is being pumped. Expensive volumetric flow rate sensors would always need to be provided in order to achieve this.

Hence, the object of the invention is to overcome the aforementioned disadvantages and to provide a pump, as well as a method related to the pump that inhibits any leakage through the pump and enables exact positioning of the rotor in the pump.

This object is attained by the combination of features according to claim 1.

According to the invention, a pump, in particular an orbital pump, for pumping a fluid is suggested. The pump comprises at least one pump control system and a motor that can be controlled by the pump control system. Further, the pump encompasses a rotor shaft for fluid transport, and a rotor sensor for detecting an absolute angle of rotation of the rotor shaft. The rotor shaft may be in direct contact with the fluid to be transported or may drive another part of the pump directly acting on the fluid without itself being in contact with the fluid. The rotor sensor is connected to the at least one pump control system and is further designed to transmit the angle of rotation of the rotor shaft to the pump control system. The pump control system is designed to control the motor accounting for the detected angle of rotation, which drives or rotates the rotor shaft until the rotor shaft is in a pre-determined angle of rotation position.

By accounting for the angle of rotation for controlling the rotor shaft and targeted and controlled positioning of the rotor shaft at a pre-determined angle of rotation position, it is possible to decrease the metering variability of the pump, such that for a repeating pump operation, a same amount of fluid may be transported each time. In particular, control accounting for the angle of rotation inhibits overshooting of the rotor shaft and thereby increases pump durability.

Additionally, by means of the exact positioning of the rotor shaft, a cavity (transport chamber) arranged in the pump may only partially be emptied, for example, by rotating the rotor shaft by a pre-determined angle, for example. Thus, since no full revolutions are needed to transport the fluid, even small amounts of fluid can be transported.

If the angles of rotation or the exact angle of rotation position of the rotor shaft are known, a pump according to the invention may also be calibrated for certain delivery rates. Such a calibration may be performed during manufacturing, for example, but also for a pump installed in a plant. If pre-determined fluid amounts are intended to be transported by the pump or if it is intended to determine which amount is transported per revolution or for the change in angle of rotation of the rotor shaft, the volume transported by the pump may be measured and related to the angle of rotation positions occurring in the process, such that it is individually established for each pump which volume is transported for which change in angle of rotation. If a certain amount of fluid (volume) is later to be transported, it can be determined from the identified values which new angle of rotation position the rotor shaft should approach starting from a current angle of rotation position. The calibration may also be repeated at specified service intervals, for example, in order to be able to account and compensate for any potential mechanical wear by means of the control system.

Starting up a pump with a stationary rotor shaft also requires different start-up currents depending on the angle of rotation position. To enable pump start-up with the smallest currents possible, a pump according to the invention and a related control system may also provide for positioning the rotor shaft at a pre-determined start-up position or at one of a plurality of pre-determined start-up positions during deactivation of the pump or during stopping of the rotor shaft. Thus, a smaller start-up current is needed for a subsequent start-up process, such that the pump is subject to little wear and comprises little current draw.

An advantageous embodiment of the invention provides that the pump comprises a pump housing, an elastically deformable pump ring, and an eccentric. The eccentric determines an off-centre hole through which the rotor shaft extends, the eccentric being connected to the rotor shaft, such that the rotor shaft drives the eccentric. Alternatively, the rotor shaft directly forms the eccentric such that the rotor shaft is the eccentric. The pump housing comprises a cylinder-shaped recess or cavity from which a fluid inlet and a fluid outlet extend from and to the pump housing, respectively. The pump ring is arranged in the cavity or in the pump housing and is spaced from the pump housing in its radial direction at least in sections. The pump ring comprises a central opening extending in an axial direction of the pump ring and preferably arranged in the pump ring centred in its radial direction, in which the eccentric is arranged. The eccentric being off-centre with respect to the central opening, the pump ring is elastically deformed by the eccentric. For this purpose, the eccentric comprises a section protruding further than the surrounding areas of the eccentric with respect to its axis of rotation about which it is rotated. The eccentric therefore particularly deforms a rotatable section of the pump ring which is deformable in a radial direction by a rotation of the eccentric in a circumferential direction of the pump ring and is pressable against the pump housing. The pump ring itself is not rotated. Only distinct areas of the pump ring are deformed and pressed against the pump housing, which causes the section of the pump ring that is deformed to move or rotate about the axis of rotation and in a circumferential direction of the pump ring, respectively. An angle of rotation of the rotatable section of the pump ring corresponds to the angle of rotation of the rotor shaft, such that the position of the rotor shaft indicated as an angle of rotation corresponds to the position of the rotatable section.

In an advantageous development, the rotor sensor is arranged on the rotor shaft, on the eccentric or on the pump ring and detects the absolute angle of rotation as the respective angle of rotation of the rotor shaft, the eccentric or the pump ring. Since the pump ring itself does not rotate, the position of the rotating section of the pump ring is thus detected.

In another advantageous variant of the invention, it is provided that the motor is an electric motor with a stator and a rotor. The rotor is directly connected to the rotor shaft or directly transitions into the same. Further, the angle of rotation of the rotor shaft corresponds to an angle of rotation of the rotor, such that the angle of rotation of the rotor shaft may be identified by means of the angle of rotation of the rotor.

Alternatively, a development provides that the motor is an electric motor with a rotor, but that the rotor is not directly connected to the rotor shaft, but instead indirectly, for example, by means of a transmission. The angle of rotation of the rotor shaft can be determined from an angle of rotation of the rotor, wherein the angle of rotation can be determined depending on the connection of the rotor to the rotor shaft, for example, the gear ratio of the transmission.

In a possible design variant of the invention, the rotor sensor is arranged on the rotor of the motor. The rotor sensor identifies the angle of rotation of the rotor and consequently, the angle of rotation of the rotor shaft.

One advantageous development provides that the rotor sensor is an encoder or a resolver detecting the angle of rotation of the rotor shaft. The encoder or the resolver may output the angle of rotation as a digital signal or as an analogue signal. In particular, output as a sine signal or cosine signal is possible.

Preferably, the rotor sensor is an absolute-value transducer, whereby no referencing of the rotor shaft is needed.

However, since the rotor shaft is preferably intended to be stopped at a pre-determined position and the angle of rotation of the rotor shaft during start-up from this position is known, an alternative embodiment provides that the rotor sensor is an incremental transducer, and the pump comprises a reference sensor detecting the position of the rotor shaft in the pre-determined angle of rotation position for referencing the rotor sensor.

The pump ring comprises, when viewed in the circumferential direction, first and second deformation sections. The pump ring is designed to be more elastically deformable in the first deformation section than in its second deformation section. In the first deformation section, the pump ring is thereby easily deformable by the eccentric in its radial direction, such that the eccentric requires a lower force to deform the pump ring in the first deformation section, or a lower torque may be applied to the eccentric for rotation about the axis of rotation. The pre-determined angle of rotation position is established in the first deformation section. Therefore, during start of the rotation of the eccentric from a standstill of the eccentric, a lower torque is needed at the eccentric in the first deformation section than during start of the rotation in the second deformation section.

Between a fluid inlet into the pump and a fluid outlet from the pump, a leakage flow channel is determined in the pump. An advantageous development of the invention provides that the leakage flow channel is closed with the rotor shaft in the pre-determined angle of rotation position. Thus, a leakage flow between the fluid inlet and the fluid outlet is inhibited. For this purpose, the rotating section of the pump ring is pressed against the fluid inlet or the fluid outlet by the eccentric, for example, such that it is fluidly sealed from an end face of the pump ring.

The invention also includes a method for controlling a pump according to the invention. A volumetric fluid flow transported by the pump from a fluid inlet to a fluid outlet of the pump is calculated from a plurality of angles of rotation of the rotor shaft detected by the rotor sensor in a pre-determined time interval. Subsequently, the motor driving the rotor shaft is controlled depending on a volumetric fluid flow to be transported according to a pre-determined motor characteristic. The volumetric fluid flow actually transported is matched to the volumetric fluid flow to be transported by the control of the motor corresponding to the motor characteristic.

A development of the method provides, in particular, that the motor is controlled to stop and position the rotor shaft at the pre-determined angle of rotation position when the volumetric flow to be transported is zero. If the rotor shaft is to be stopped by the motor at the pre-determined angle of rotation position, the motor characteristic corresponds to a slow deceleration of the motor, for example, such that the rotor shaft comes to a rest at the pre-determined position without overshooting at the same.

Other advantageous developments of the invention are characterised in the dependent claims or are further set forth below by reference to the FIGURE. In the FIGURE:

FIG. 1 shows an orbital pump with a cut-away pump housing in a top view of the pump ring.

The pump schematically depicted in FIG. 1 is provided with a rotor sensor and a pump control system even though they are not recognisable in the FIGURE.

The pump housing 10 is shown in a section orthogonal to a longitudinal axis such that the cavity 14 located in the pump housing 10 is visible with the components arranged therein. As part of the pump housing 10, a fluid inlet 11 with a channel extends into the cavity 14 and a fluid outlet 12 with a channel extends from the cavity 14. An elastically deformable pump ring 20 is arranged in the cavity 14. The rotor shaft 40 shown in section passes through the centre of the cavity 14, which is cylinder-shaped or designed to be round in the sectional view, along an axis of rotation not depicted and extending along its axial direction orthogonal to the page. An eccentric 30 is arranged on the rotor shaft 40 and acts on or presses against the elastically deformable pump ring 20 by means of a bearing ring 32 between the pump ring 20 and the eccentric 30. The bearing ring 32 is a needle bearing, for example, formed from needle elements and embodied as a radial bearing whereby the eccentric 30 may rotate therein in the pump ring 20, deforming the pump ring 20 without directly abutting the deformable pump ring 20. With the rotor shaft 40 at its depicted angle of rotation, the eccentric 30 presses the pump ring 20 in the eccentric direction 31, causing the elastically deformable pump ring 20 to be deformed in its radial direction located in the page such that the section 21 of the pump ring 20 abuts the pump housing 10 in the radial direction. By means of a rotation of the eccentric in the circumferential direction U, the deformed section 21 of the pump ring 20 moves in the circumferential direction U about the axis of rotation, such that the section 21 rotates in the circumferential direction without the pump ring 20 rotating at the same time. The pump ring 20 is spaced from the pump housing 10 in sections and only abuts the pump housing 10 in the radial direction in the rotating section 21 and in a sealing section 22. By rotating the rotating section 21 of the pump ring 20 and spacing the pump ring 20 from the pump housing 10 in the radial direction, two chambers varying in size by means of the rotation of the rotating section 21 are determined in the cavity 14 by the pump housing 10 and the pump ring 20. A fluid is drawn into a first chamber connected to the fluid inlet 11 through the fluid inlet 11 into the cavity 14 or the first chamber increasing in size, and a fluid is expelled from the second chamber connected to the fluid outlet 12 from the cavity 14 or from the second chamber decreasing in size.

Between a fluid inlet 11 into the pump and a fluid outlet 12 from the pump, a leakage flow channel 15 is determined in the pump. An advantageous development of the invention provides that the leakage flow channel 15 is closed with the rotor shaft 40 in the pre-determined angle of rotation position. Thus, a leakage flow between the fluid inlet 11 and the fluid outlet 12 is inhibited. For this purpose, the rotating section of the pump ring 20 is pressed against the fluid inlet 11 or the fluid outlet 12 by the eccentric, for example, such that it is fluidly sealed from an end face of the pump ring 20.

The pump ring 20 comprises two deformation sections 24, 25 in the circumferential direction U adjacent to each other or across a range of angles in the circumferential direction U. In the first deformation section 24, a deformation force is already applied to the pump ring 20 in the radial direction by the pin 13 extending parallel to the axis of rotation. Additionally, a cavity located at the pin 13 is formed in the pump ring 20 between the pin 13 and the eccentric 30 through which the pump ring 20 can be more easily deformed in the radial direction. The pump ring 20 may, in the first deformation section 24, also comprise further measures for easier deformability as compared to the adjoining second deformation section 25. Due to the easier deformability in the first deformation section 24, a lower torque needs to be applied to the rotor shaft 40 during a rotation across the range of angles of rotation across which the first deformation section 24 extends. In the pump shown as an example, the pre-determined angle of rotation position is therefore symmetrical to the pin 13 on the straight line bisecting the rotor shaft 40 and the pin 13. This pre-determined angle of rotation position may, for example, be defined as 0°, with the depicted eccentric depicted at an angle of rotation position turned by 90° along the rotation path 33. The angle of rotation of the rotor shaft 40 may in the depicted pump, for example, be detected at the rotor shaft 40, at the eccentric 30, at the pump ring 20 by means of the rotating section 21 of the pump ring 20, or at a rotor of a motor not depicted and driving the rotor shaft 40. The eccentric 30 is presently integrally connected to the rotor shaft 40, wherein the rotor shaft 40 may also integrally form the eccentric 30.

The invention claimed is:

1. A pump for pumping a fluid, wherein the pump comprises at least one pump control system, a motor that can be controlled by the pump control system, a rotor shaft (40) for fluid transport, and a rotor sensor for detecting an absolute angle of rotation of the rotor shaft (40), the rotor sensor is connected to the pump control system and designed to transmit the angle of rotation of the rotor shaft (40) to the pump control system, and the pump control system is designed to rotationally control the rotor shaft (40) by means of the motor until the rotor shaft (40) is in a pre-determined angle of rotation position based on the angle of rotation of the rotor shaft (40) transmitted from the rotor sensor;

wherein between a fluid inlet (11) into the pump and a fluid outlet (12) from the pump, a leakage flow channel (15) is formed in a cavity in the pump and the leakage flow channel (15) is closed when the rotor shaft (40) is in the pre-determined angle of rotation position to inhibit leakage flow of the fluid between the fluid inlet (11) and the fluid outlet (12).

2. The pump of claim 1, wherein the pump comprises a pump housing (10), an elastically deformable pump ring (20), and an eccentric (30) driven by or formed by the rotor shaft (40), the pump ring (20) is arranged in the pump housing (10) and is spaced from the pump housing (10) in its radial direction at least in sections, the pump ring (20) comprises a central opening in which the eccentric (30) is arranged, and a deformed section (21) of the pump ring (20) is deformable in a radial direction by a rotation of the eccentric (30) in a circumferential direction (U) of the pump ring (20) and is pressable against the pump housing (10), wherein an angle of rotation of the deformed section (21) of the pump ring (20) corresponds to the angle of rotation of the rotor shaft (40).

3. The pump of claim 2, wherein the rotor sensor is arranged on the rotor shaft (40), on the eccentric (30) or on the pump ring (20) and detects the respective angle of rotation.

4. The pump of claim 1, wherein the motor is an electric motor with a rotor, the rotor is directly connected to the rotor shaft (40), and the angle of rotation of the rotor shaft (40) corresponds to an angle of rotation of the rotor.

5. The pump of claim 1, wherein the motor is an electric motor with a rotor, the rotor is indirectly connected to the rotor shaft (40), and the angle of rotation of the rotor shaft (40) can be determined from an angle of rotation of the rotor.

6. The pump of claim 4, wherein the rotor sensor is arranged on the rotor and identifies the angle of rotation of the rotor.

7. The pump of claim 1, wherein the rotor sensor is an encoder or a resolver detecting the angle of rotation of the rotor shaft (40).

8. The pump of claim 1, wherein the rotor sensor is an absolute-value transducer.

9. The pump of claim 1, wherein the rotor sensor is an incremental transducer, and the pump comprises a reference sensor detecting the position of the rotor shaft (40) in the pre-determined angle of rotation position for referencing the rotor sensor.

10. The pump of claim 2, wherein the pump ring (20) comprises, when viewed in the circumferential direction (U), first and second deformation sections (24, 25), the pump ring (20) is designed to be more elastically deformable in the first deformation section (24) than in its second deformation section (25), and wherein the pre-determined angle of rotation position is established in the first deformation section (24).

11. A method for controlling the pump of claim 1, wherein a volumetric fluid flow transported through the pump from the fluid inlet (11) to the fluid outlet (12) of the pump is calculated from a plurality of angles of rotation of the rotor shaft (40) detected by the rotor sensor in a pre-determined time interval, and the motor driving the rotor shaft (40) is controlled depending on a volumetric fluid flow to be transported according to a pre-determined motor characteristic that controls rotation of the rotor shaft (40) to achieve a volumetric fluid flow to be transported that corresponds to the calculated volumetric fluid flow that was transported through the pump.

12. The method of claim 11, wherein the motor is controlled to stop and position the rotor shaft (40) at the pre-determined angle of rotation position when the volumetric flow to be transported is zero.

13. The pump of claim 5, wherein the rotor sensor is arranged on the rotor and identifies the angle of rotation of the rotor.

14. The pump of claim 1, wherein the pump control system is designed to control metering by the pump using the angle of rotation of the rotor shaft (40) transmitted from the rotor sensor to transport fluid from the cavity in the pump whereby the rotor shaft (40) is rotated by a predetermined angle relative to the pre-determined angle of rotation position that closes the leakage flow channel (15) that is less than a full revolution.

* * * * *